US006397436B1

(12) United States Patent
Wang

(10) Patent No.: US 6,397,436 B1
(45) Date of Patent: Jun. 4, 2002

(54) SUITCASE HANDLE HAVING DAMPING DEVICE

(76) Inventor: King Sheng Wang, No. 191, Dong Si 9th Road, Si An Tsuen, Da An Hsiang, Taichung Hsien (TW), 439

( * ) Notice: Subject to any disclaimer, the term of this patent is extended or adjusted under 35 U.S.C. 154(b) by 0 days.

(21) Appl. No.: 09/771,602

(22) Filed: Jan. 30, 2001

(51) Int. Cl.[7] ..... A45C 13/22; A45F 5/10

(52) U.S. Cl. ..... 16/445; 16/405; 16/408; 16/444; 16/438; 16/114.1; 190/115; 190/39

(58) Field of Search ..... 16/114.1, 405, 16/408, 444, 445, 438; 190/39, 115; 292/336.3; 188/290; 296/214, 39.1, 97.1

(56) References Cited

U.S. PATENT DOCUMENTS

| | | | | |
|---|---|---|---|---|
| 2,254,506 | A | 9/1941 | Wheary, Jr. | 16/409 |
| 3,562,849 | A | 2/1971 | Brayshaw | 16/445 |
| 4,589,162 | A | 5/1986 | Manz et al. | 16/429 |
| 4,893,522 | A | 1/1990 | Arakawa | 16/82 |
| 5,001,809 | A | 3/1991 | Kim et al. | 16/62 |
| 5,465,462 | A | 11/1995 | Yamada | 16/429 |
| 5,743,575 | A | 4/1998 | McFarland | 16/82 |
| 5,867,872 | A | 2/1999 | Katoh | 16/337 |
| 6,055,706 | A | 5/2000 | Dioguardi et al. | 16/226 |
| 6,223,395 | B1 | 5/2001 | Miho et al. | 16/429 |
| 6,230,925 | B1 | 5/2001 | Hardigg et al. | 220/761 |

*Primary Examiner*—Chuck Y. Mah
(74) *Attorney, Agent, or Firm*—Charles E. Baxley

(57) ABSTRACT

A handle is rotatably secured to a housing with a pivot shaft for allowing the handle to be rotated relative to the housing between a working and a storing position. A spring may bias the handle to rotate relative to the housing from the working position to the storing position. A damping device may be used to damp the rotational movement of the handle relative to the housing and includes a gear provided on the pivot shaft, a tube rotatably received in the housing and having a pinion engaged with the gear for preventing the handle from sprung back to the storing position.

12 Claims, 5 Drawing Sheets

SUITCASE HANDLE HAVING DAMPING DEVICE

BACKGROUND OF THE INVENTION

1. Field of the Invention

The present invention relates to a handle, and more particularly to a handle for a suitcase of the like.

2. Description of the Prior Art

Typical suitcases comprise a handle for carrying purposes, and may comprise a spring member engaged with the handle for biasing the handle backward to the folded or storing position. The users have to rotate or pull the handle relative to or against the spring member in order to rotate or to pull the handle to the open or working position. However, once the handle is released, the spring member may bias the handle back to the folded or storing position quickly and may thus hurt the users inadvertently.

The present invention has arisen to mitigate and/or obviate the afore-described disadvantages of the conventional handles for suitcases.

SUMMARY OF THE INVENTION

The primary objective of the present invention is to provide a handle for a suitcase or the like including a damping device for preventing the handle from being sprung back or rotated backward to the folded or storing position rapidly and for preventing the sprung back handle from hurting the users or the children inadvertently.

In accordance with one aspect of the invention, there is provided a handle comprising a housing, a handle body rotatably secured to the housing with a pivot shaft for allowing the handle body to be rotated relative to the housing between a working position and a storing position, means for biasing the handle body from the working position to the storing position, and means for damping a rotational movement of the handle body from the working position to the storing position.

The housing includes two ends each having a cavity for rotatably receiving two pins of the pivot shaft. The handle body includes a rod extended from the pivot shaft and having a channel formed in the rod, the biasing means includes a coil spring engaged on the rod and having a first end engaged in the channel of the rod and having a second end engaged with the housing.

The damping means includes a gear provided on the pivot shaft of the handle body, a tube rotatably received in the housing and having a pinion attached thereto and engaged with the gear of the handle, for allowing the tube to be rotated by the handle body when the handle body is rotated between the working position and the storing position.

The damping means further includes a barrel secured in the housing, the tube is rotatably received in the barrel. The housing includes a projection, the barrel includes a first end having a notch formed therein for receiving the projection and for preventing the barrel from rotating relative to the housing.

The damping means includes a damp fluid received in the barrel and received between the tube and the barrel for damping a rotational movement of the tube relative to the barrel.

The tube includes an outer peripheral portion having at least one groove formed therein. The tube includes at least one orifice formed therein and communicating with an inner portion and an outer portion of the tube for allowing the damping fluid to flow between the inner portion and the outer portion of the tube via the at least one orifice of the tube.

The damping means further includes a pipe received in the tube and secured to the barrel. The pipe includes an opening formed therein, the barrel includes a stop extended therefrom and engaged into the opening of the pipe for preventing the pipe from rotating relative to the barrel.

The pipe includes an outer peripheral portion having at least one groove formed therein for receiving the damping fluid.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
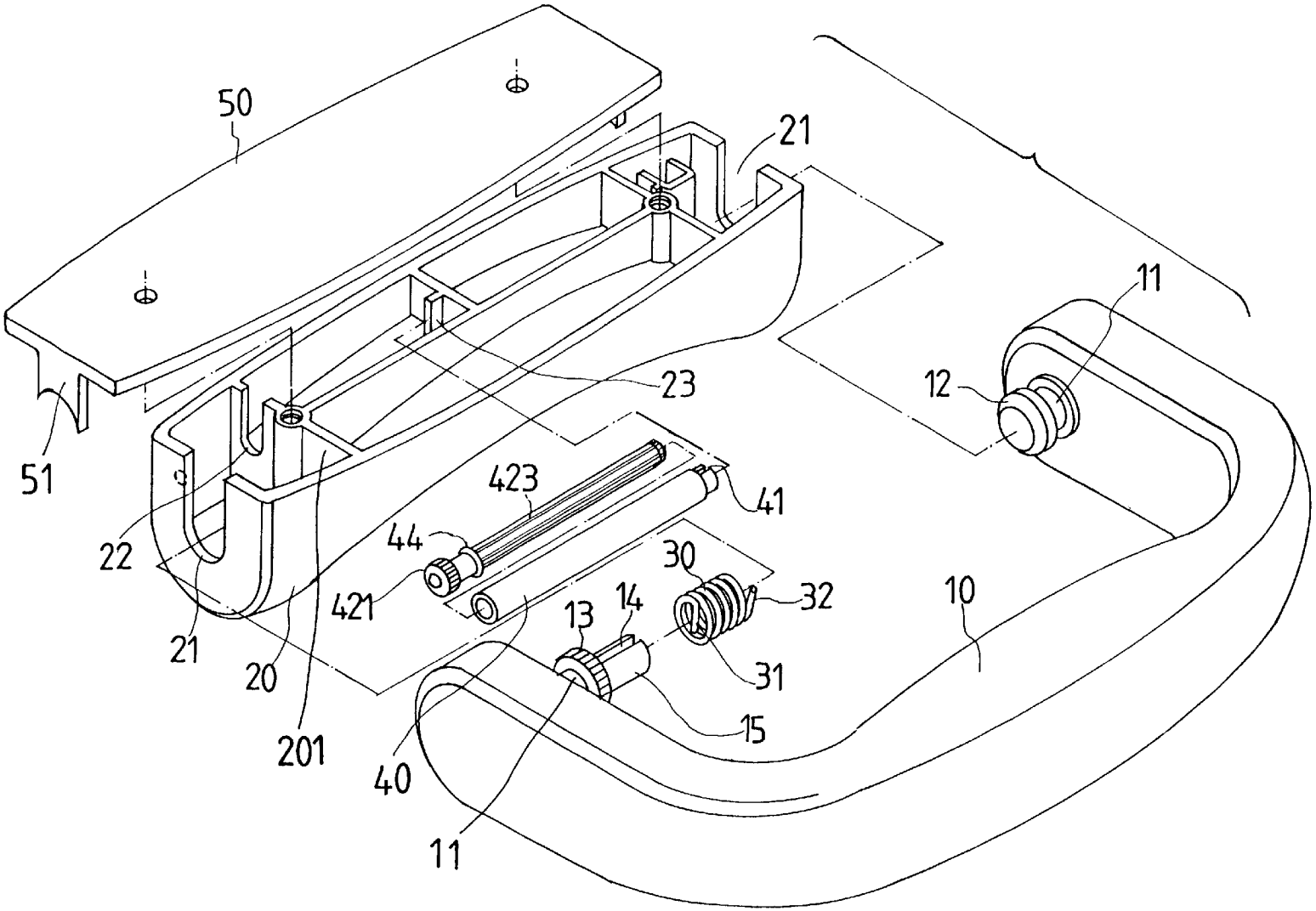
FIG. 1 is an exploded view of a handle in accordance with the present invention.
Figure 2:
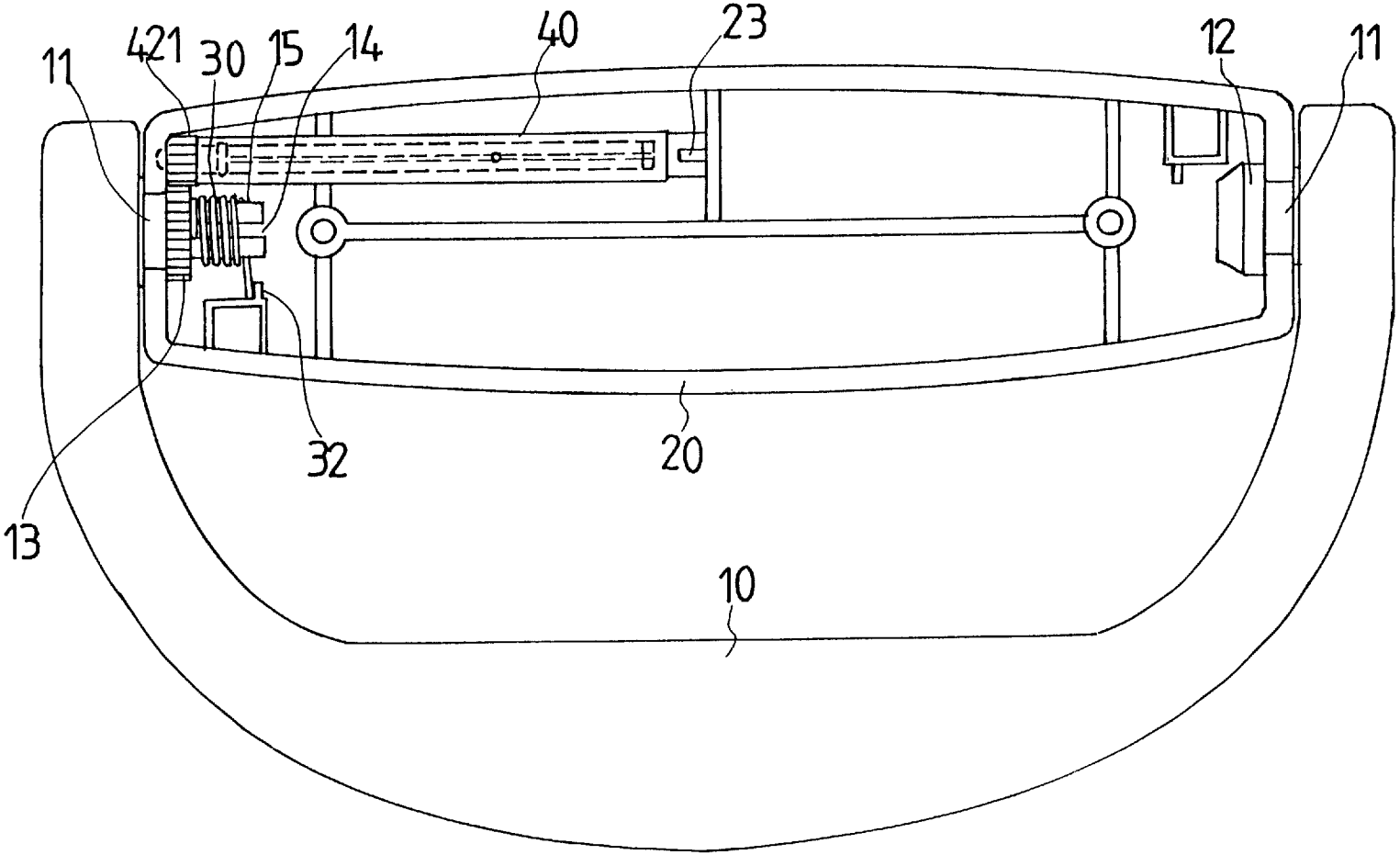
FIG. 2 is a top plane view of the handle, in which the cover of the housing is removed for showing the inner structure of the handle.

Referring to the drawings, and initially to FIGS. 1–4, a handle in accordance with the present invention comprises a substantially C or U-shaped handle body 10 to be attached to a housing 20. The housing 20 may be secured to the suitcase or the like, and includes two ends each having a cavity 21 formed therein, and includes a partition provided therein and close to one end thereof and having a depression 22 formed therein, and includes a projection 23 extended or provided in the middle portion thereof. The handle body 10 includes a pivot shaft having such as two pins 11 attached or secured to the ends of the handle body 10 and pivotally or rotatably received in the cavities 21 of the housing 20 for rotatably securing the handle body 10 to the housing 20. The pins 11 form the pivot shaft of the handle body 10 to the housing 20. A cover 50 is secured to the housing 20 and includes two protrusions 51 engaged into the cavities 21 of the housing 20, for stably and rotatably securing the pins 11 of the handle body 10 within the cavities 21 of the housing 20, and for rotatably securing the handle body 10 to the housing 20.

The handle body 10 includes an enlarged head 12 and a gear 13 formed or provided on the free ends of the pins 11 respectively for further solidly and rotatably securing the pins 11 to the housing 20, and includes a rod 15 extended from the gear 13 and having a channel 14 formed therein. A spring member 30, such as a coil spring 30 is engaged on the rod 15 (FIGS. 2, 3, 5) and includes one end 31 engaged in the channel 14 of the rod 15 and includes the other end 32 engaged with the housing 20 for biasing and rotating the handle 10 downward to the folding or storing position, as shown in dotted lines in FIG. 3. The users may pull or rotate the handle body 10 upward to the erect or open or working position against the spring 30, as shown in solid lines in FIG. 3.

Figure 4:
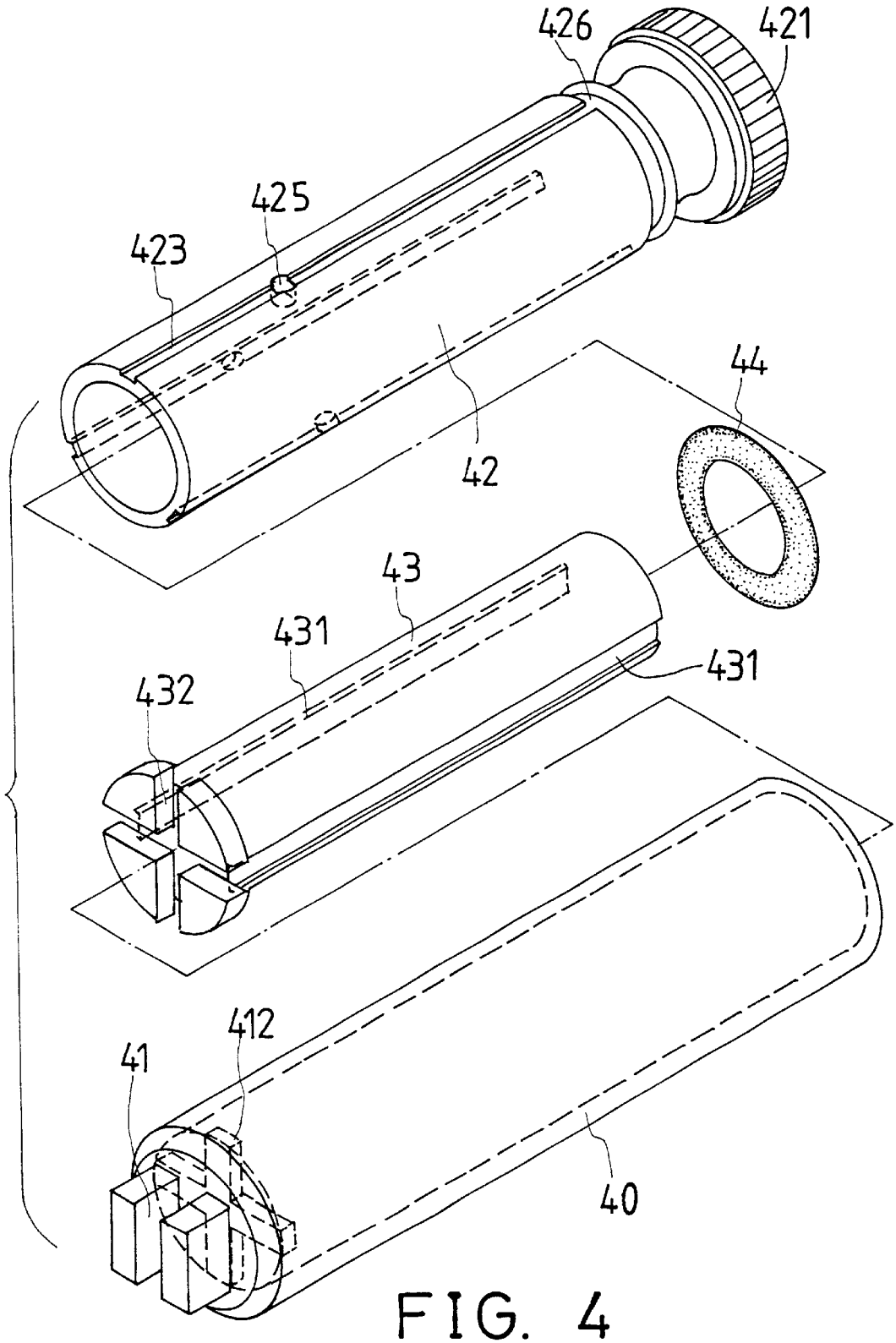
FIG. 4 is an exploded view of the damping device.

Referring next to FIGS. 1 and 4, the handle further includes a damp device for damping the backward rotation of the handle body 10 from the working position to the folding or storing position. The damp device includes a barrel 40 engaged in the housing 20 and having a middle portion stably received in the depression 22 of the housing 20. The barrel 40 includes a notch 41 formed in one end thereof for receiving the projection 23 of the housing 20 and for preventing the barrel 40 from rotating relative to the housing 20. The barrel 40 includes a stop 412, such as a cross-shaped stop 412 formed in the inner portion thereof.

A tube 42 is rotatably received in the barrel 40 and includes a pinion 421 provided on one end thereof and engaged with the gear 13 of the handle body 10, such that the tube 42 may be caused and forced to rotate relative to the barrel 40 when the gear 13 is rotated by the handle body 10 and when the handle body 10 is rotated between the working position and the storing position. The tube 42 includes a peripheral recess 426 formed in the one end thereof for receiving a sealing ring 44 which is engaged between the tube 42 and the barrel 40 for making a water tight seal between the tube 42 and the barrel 40 and for allowing a damping fluid to be sealingly received in the barrel 40 and the tube 42. The tube 42 includes one or more longitudinal grooves 423 formed in the outer peripheral portion thereof for receiving the damping fluid, and includes one or more orifices 425 formed therein and communicating with the grooves 423 thereof for communicating the inner and outer portions of the tube 42 and for allowing the damping fluid to flow into the tube 42. The damping fluid may thus be used to damp the rotational movement between the tube 42 and the barrel 40.

A pipe 43 may further be provided and rotatably received in the tube 42 and includes an opening 432, such as a cross-shaped opening 432 formed in one end thereof for receiving the corresponding cross-shaped stop 412 of the barrel 40 and for preventing the pipe 43 from rotating relative to the barrel 40. The pipe 43 includes one or more longitudinal grooves 431 formed in the outer peripheral portion thereof for receiving the damping fluid and for further facilitating the damping effect of the damping fluid to or against the rotational movement of the tube 42 relative to the barrel 40 and the pipe 43.

Figure 3:
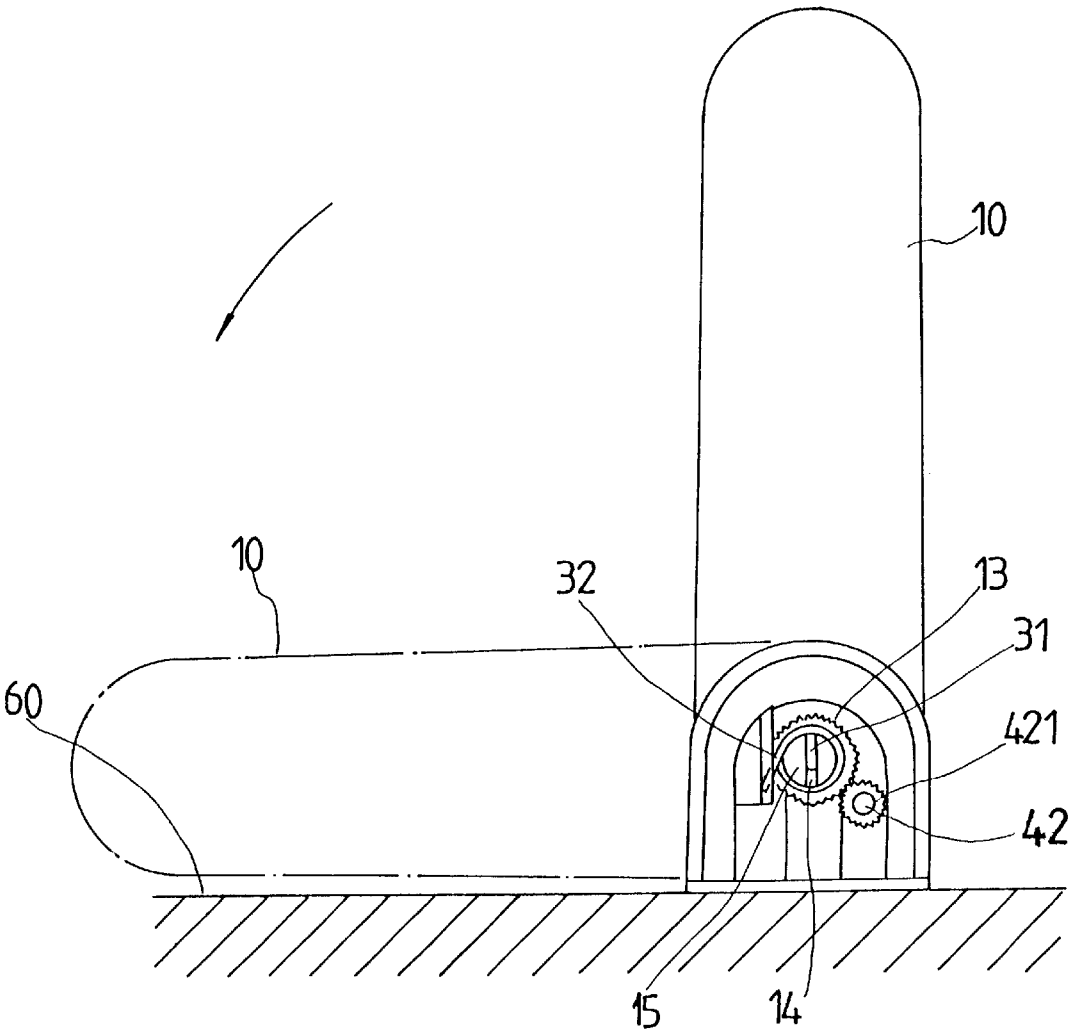
FIG. 3 is an end view illustrating the operation of the handle.

In operation, as shown in FIG. 3, the tube 42 may be rotated relative to the barrel 40 by the engagement between the gear 13 of the handle body 10 and the pinion 421 of the tube 42 when the handle body 10 is rotated relative to the housing 20 against the spring member 30 between the working position and the storing position. The damping fluid received in the barrel 40 and the tube 42 and the pipe 43 may be used to damp the rotational movement of the tube 42 relative to the barrel 40, such that the handle body 10 may be prevented from being sprung back or rotated backward from the working position to the folded or storing position rapidly and and may thus prevent the sprung back handle from hurting the users or the children inadvertently.

Figure 5:
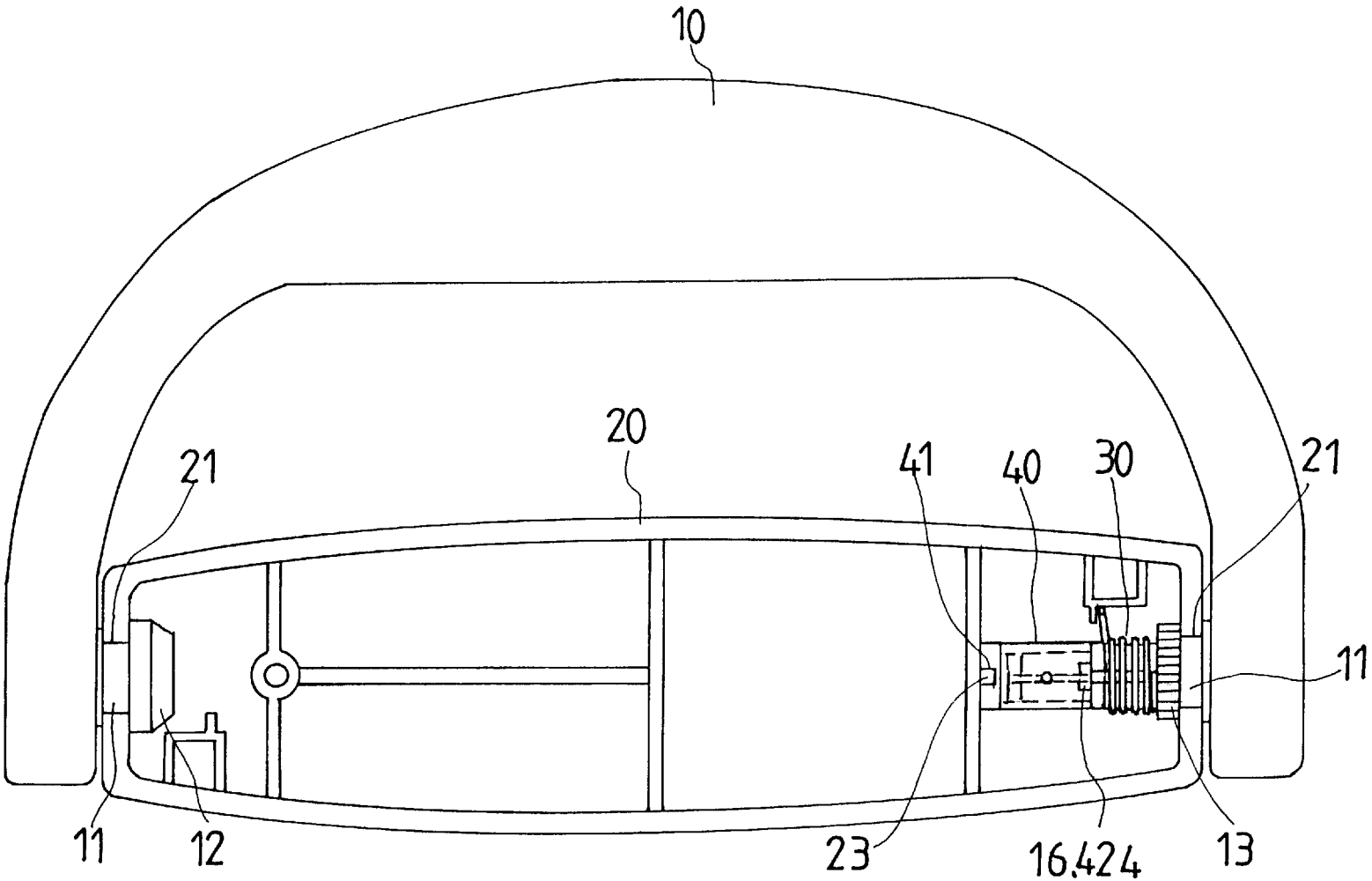
FIG. 5 is a plane view similar to FIG. 2, illustrating the other embodiment of the damping device for the handle.

Referring next to FIG. 5, the handle body 10 may directly include a paddle wheel, a non-circular extension 16 or the like extended from the rod 15 and engaged in the barrel 40 for engaging with the damping fluid received in the barrel 40 and for damping the rotational movement of the tube 42 relative to the barrel 40.

Accordingly, the handle for a suitcase or the like in accordance with the present invention includes a damping device for preventing the handle from being sprung back or rotated backward to the folded or storing position rapidly and for preventing the sprung back handle from hurting the users or the children inadvertently.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A handle comprising:

a housing, a handle body rotatably secured to said housing with a pivot shaft for allowing said handle body to be rotated relative to said housing between a working position and a storing position, means for biasing said handle body from said working position to said storing position, and means for damping a rotational movement of said handle body from said working position to said storing position.

2. The handle according to claim 1, wherein said housing includes two ends each having a cavity formed therein, said pivot shaft of said handle body includes two pins rotatably received in said cavities of said housing.

3. The handle according to claim 1, wherein said handle body includes a rod extended from said pivot shaft and having a channel formed in said rod, said biasing means includes a coil spring engaged on said rod and having a first end engaged in said channel of said rod and having a second end engaged with said housing.

4. The handle according to claim 1, wherein said damping means includes a gear provided on said pivot shaft of said handle body, a tube rotatably received in said housing and having a pinion attached thereto and engaged with said gear of said handle, for allowing said tube to be rotated by said handle body when said handle body is rotated between said working position and said storing position.

5. The handle according to claim 4, wherein said damping means further includes a barrel secured in said housing, said tube is rotatably received in said barrel.

6. The handle according to claim 5, wherein said housing includes a projection extended therein, said barrel includes a first end having a notch formed therein for receiving said projection and for preventing said barrel from rotating relative to said housing.

7. The handle according to claim 5, wherein said damping means includes a damp fluid received in said barrel and received between said tube and said barrel for damping a rotational movement of said tube relative to said barrel.

8. The handle according to claim 7, wherein said tube includes an outer peripheral portion having at least one groove formed therein.

9. The handle according to claim 7, wherein said tube includes at least one orifice formed therein and communicating with an inner portion and an outer portion of said tube for allowing said damping fluid to flow between said inner portion and said outer portion of said tube via said at least one orifice of said tube.

10. The handle according to claim 7, wherein said damping means further includes a pipe received in said tube and secured to said barrel.

11. The handle according to claim 10, wherein said pipe includes an opening formed therein, said barrel includes a stop extended therefrom and engaged into said opening of said pipe for preventing said pipe from rotating relative to said barrel.

12. The handle according to claim 10, wherein said pipe includes an outer peripheral portion having at least one groove formed therein for receiving said damping fluid.

* * * * *